US007305972B2

(12) United States Patent
Kloos et al.

(10) Patent No.: US 7,305,972 B2
(45) Date of Patent: Dec. 11, 2007

(54) METHOD OF CONTROLLING AN INTERNAL COMBUSTION ENGINE

(75) Inventors: Albert Kloos, Friedrichshafen (DE); Michael Willmann, Bermatingen (DE); Günther Schmidt, Friedrichshafen (DE); Ralf Speetzen, Friedrichshafen (DE); Stefan Müller, Friedrichshafen (DE); Andreas Kunz, Friedrichshafen (DE)

(73) Assignee: KTU Friedrichshafen GmbH, Friedrichshafen (DE)

( * ) Notice: Subject to any disclaimer, the term of this patent is extended or adjusted under 35 U.S.C. 154(b) by 0 days.

(21) Appl. No.: 11/499,966

(22) Filed: Aug. 7, 2006

(65) Prior Publication Data

US 2006/0266332 A1 Nov. 30, 2006

Related U.S. Application Data

(63) Continuation-in-part of application No. PCT/EP2005/001226, filed on Feb. 8, 2006.

(51) Int. Cl.
*F02M 65/00* (2006.01)

(52) U.S. Cl. ..... 123/479; 123/673; 701/105

(58) Field of Classification Search ..... 123/479, 123/673; 701/105

See application file for complete search history.

(56) References Cited

U.S. PATENT DOCUMENTS 4,814,992 A * 3/1989 Sakurai et al. ..... 701/105
6,474,306 B2 * 11/2002 Muller et al. ..... 123/479
7,168,413 B2 * 1/2007 Oono ..... 123/479

* cited by examiner

*Primary Examiner*—Erick R Solis
(74) *Attorney, Agent, or Firm*—Klaus J. Bach

(57) ABSTRACT

In a method of controlling an internal combustion engine having a common rail fuel injection system including individual fuel storage chambers, wherein the pressure pattern of the fuel supplied to each injector can be determined and actual and virtual fuel injection ends and fuel injection begins are determined, the deviations from the desired fuel injection ends and from the fuel injection begins are calculated and the injectors are evaluated on the basis of the deviations and further control of the internal combustion engine is based on an evaluation of the fuel injectors.

11 Claims, 4 Drawing Sheets

METHOD OF CONTROLLING AN INTERNAL COMBUSTION ENGINE

This is a Continuation-In-Part Application of International Application PCT/EP2005/001226 filed Feb. 8, 2006 and claiming the priority of German application 10 2004 006896.8 filed Feb. 12, 2004.

BACKGROUND OF THE INVENTION

The invention resides in a method of controlling an internal combustion engine including a common rail fuel injection system with individual storage chambers, wherein an actual injection end is determined from the pressure pattern of the individual storage chambers and a virtual injection begin is determined.

In an internal combustion engine, the start and the end of the fuel injection determine to a large extend the quality of the combustion and the composition of the exhaust gas. In order to maintain legal limits, these two characteristic values are generally controlled by an electronic control unit. In practice, however, there is the problem that, in an internal combustion engine with a common rail system, there is always some time delay between the start of the energization of the injectors, that is the injector needle actuation and the actual fuel injection begin. Correspondingly, the same is true for the fuel injection termination.

DE 198 50 221 C1 discloses a method for the examination of an injector. Herein, different injector operating points are determined by varying the pressure of the injector outlet while the inlet pressure is maintained constant. The injector is in good operating condition, that is, it is fault free, if the operating points are within a reliable area of a test performance graph. The testing procedure is used on an injector testing bench. It cannot be used when for injectors while they are installed in an internal combustion engine.

German Patent Application DE 103 44 181.6 (which is not a prior art document) discloses a method of controlling an internal combustion engine wherein from the pressure pattern in an individual storage chamber of a common rail fuel injection system, the end of the fuel injection is detected. From the measured end of the fuel injection then, via a mathematical function, a virtual injection begin is calculated. However, changes of injector properties over the operating life of an injector are not taken into consideration with the method.

It is the object of the present invention to provide for an internal combustion engine with a common rail fuel injection system including individual storage chambers a testing method for the fuel injectors of the engine with the injectors mounted to the engine.

SUMMARY OF THE INVENTION

In a method of controlling an internal combustion engine having a common rail fuel injection system including individual fuel storage chambers, wherein the pressure pattern of the fuel supplied to each injector can be determined and actual and virtual fuel injection ends and fuel injection begins are determined, the deviations from the desired fuel injection ends and from the fuel injection begins are calculated and the injectors are evaluated on the basis of the deviations and further control of the internal combustion engine is based on an evaluation of the fuel injectors.

For the evaluation of the injector, an injection end tolerance band is selected and it is then examined whether the injection and deviation is within the fuel injection end tolerance band. Supplementary, an injection start tolerance band is selected and it is also tested whether the injection start deviation is within this tolerance band. The selection of the respective band and the limit values thereof is then made depending on the operating state of the internal combustion engine. The fuel injector is evaluated as being fault free if the injection end deviation and the injection start deviation are both within the respective tolerance bands. If they are outside the respective tolerance bands, the injector is evaluated as being faulty. Depending on the location of the injection begin deviation or the injection end deviation relative to evaluation limit values it is deviation relative to evaluation limit values, it is determined whether the injector should be deactivated or the parameters of the injector, particularly the energization begin and the energization duration, should be adapted.

With the present invention, the properties of the individual injectors can be determined over their life. Since the properties of the individual fuel injectors are known, the injectors can be uniformly adjusted so that their injection behaviors are the same. The better knowledge of the injectors permits on optimization of their use potentials with respect to lowering the fuel consumption and the emissions of a motor vehicle. As far as the servicing of the internal combustion engine is concerned, the service intervals can be extended. Furthermore, a certain diagnosis with service proposals for the servicing personnel can be provided.

The invention will become more readily apparent from the following description of a preferred embodiment thereof on the basis of the accompanying drawings.

DETAILED DESCRIPTION OF THE METHOD OF THE INVENTION

Figure 1:
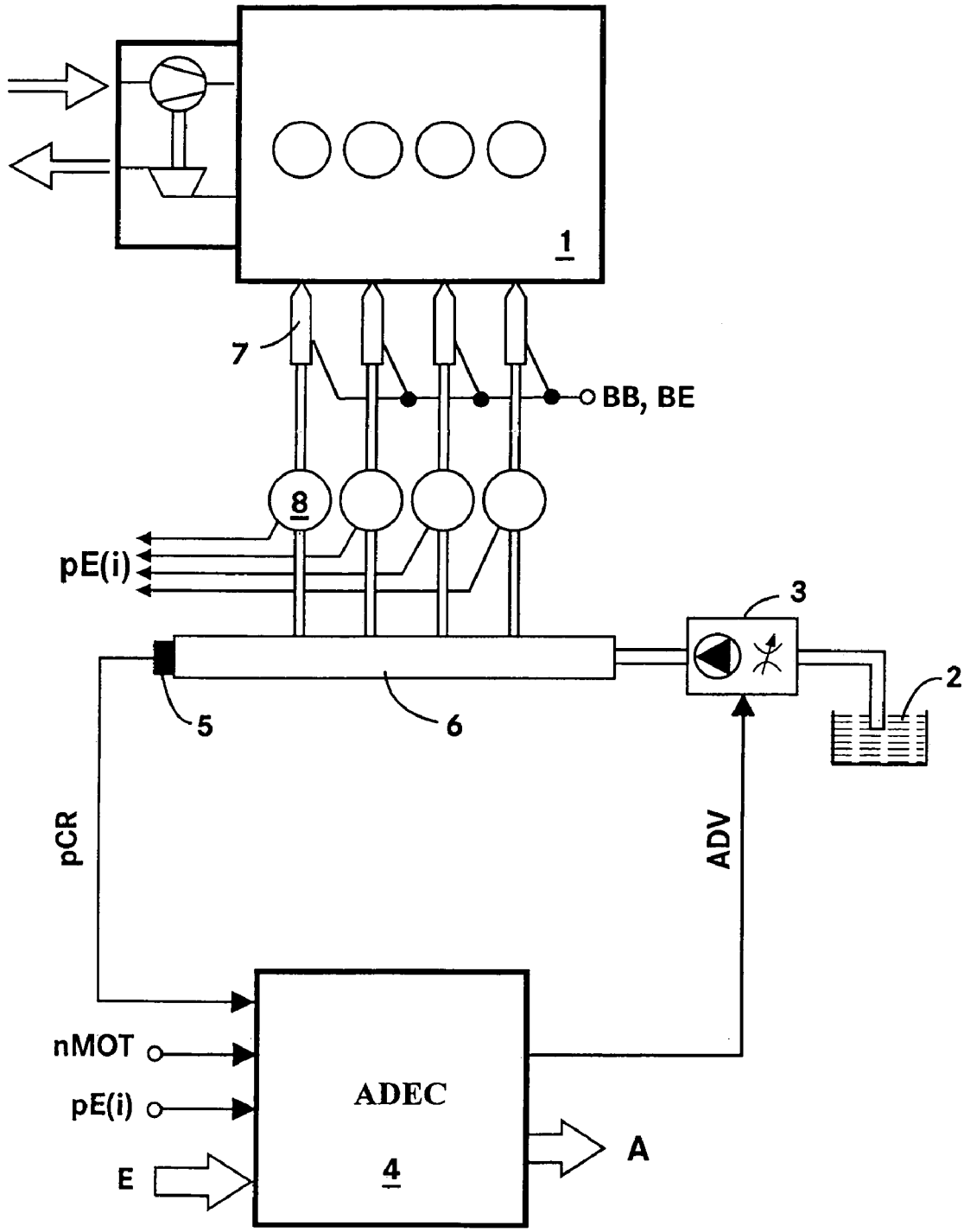
FIG. 1 shows schematically an arrangement for performing the method according to the invention.

FIG. 1 shows schematically an electronically controlled internal combustion engine. In the internal combustion engine 1 shown the fuel is injected by way of a common rail system which comprises the following components: Pumps 3 with a suction throttle for pumping the fuel from a fuel tank 2, a rail 6, individual storage chambers 8, and injectors 7 for injecting the fuel into the combustion chambers of the internal combustion engine 1. In this system, the hydraulic resistance of the individual chambers 8 and the supply lines is appropriately adapted. For the invention, it is unimportant whether the rail 6 has a storage volume or is only a simple fuel supply line.

The operation of the internal combustion engine 1 is controlled by an electronic control unit (ADEC) 4. The electronic control unit 4 comprises the usual components of a microcomputer system, such as a microprocessor, I/O components, buffers and storage components (EEPROM, RAM). In the storage components, the operational data relevant for the operation of the internal combustion engine are stored in the form of performance graphs and characteristic lines. By way of these graphs and lines, the electronic control unit 4 calculates from the input values the output values. FIG. 1 shows for example the following input values: a rail pressure pCR which is measured via a pressure sensor 5, a speed signal nMOT of the internal combustion engine 1, pressure signals pE(i) of the individual storage chambers 8 and an input value E. The input value E represents for example the sum of the charge air pressure of a turbocharger and the temperatures of the coolant/lubricant and the fuel.

In FIG. 1, as output values of the electronic control units 4, a signal ADV for controlling the pumps 3 via the suction throttle and an output value A are shown. The output value A stands for example for the additional control signals for controlling the internal combustion engine 1 such as energization start BB and the energization and BE of the fuel injectors.

Figure 2:
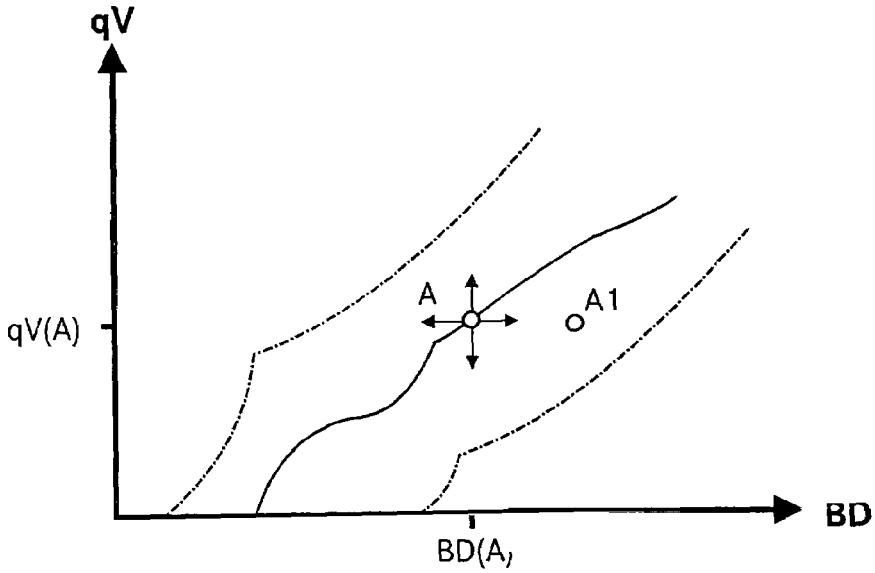
FIG. 2 shows an injector performance graph.

FIG. 2 shows an injector performance graph. On the abscissa, the energization duration BD is plotted and on the ordinate an injection amount qV is plotted. By way of the characteristic injector line, an energization duration BD is assigned to a calculated injection amount. For example, an operating point A and a corresponding energization duration BDCA are assigned to the fuel injection amount qV(A). Two limit value lines are represented by dash-dotted liens. The operating point A changes over the life of the injector. The reasons herefor are the magnetic changes of the magnetic circuit, the hydraulic changes such as changes in the throttle cross-section and the mechanical changes such as wear. The changes of the operating point A are indicated in the figure by corresponding arrows. As a result, a new operating point for example operating point A1 may be established.

Figure 3:
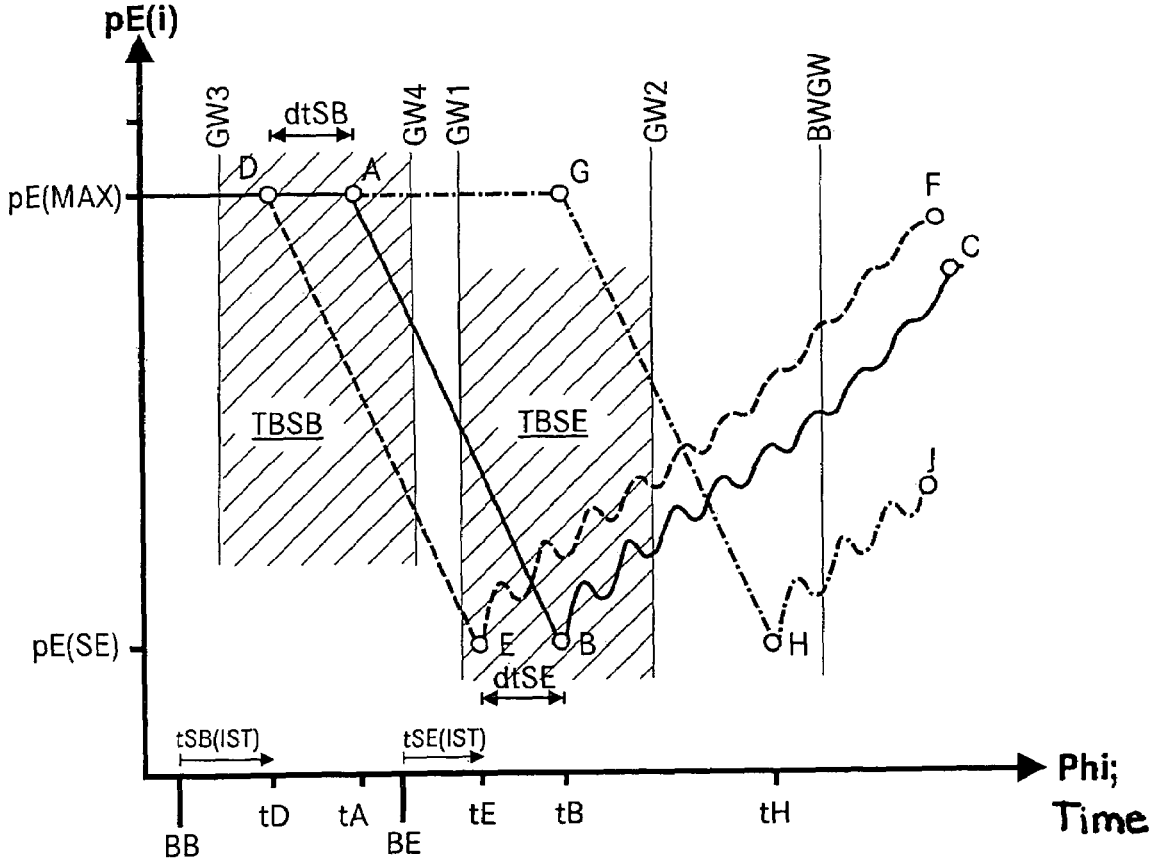
FIG. 3 shows injector pressure patterns.

FIG. 3 shows in an exemplary way several pressure curves. On the abscissa, the crankshaft angle Phi or as an equivalent the time is plotted. A desired injection pattern is shown as a solid line including the points A, B and C. The dashed line with the points D, E and F indicators a first actual injection pattern. A second injection pattern is shown by the dash dotted line including the points A, G, H, and J. A preliminary injection and a follow-up injection are omitted from the respective injection lines for clarity reasons. An injection begin tolerance band with the limit values GW3 and GW4 is designated by the reference symbol TBSB. The reference symbol TBSE indicates an injection end tolerance band with the limit values GW1 and GW2. FIG. 3 also shows an ordinate-parallel line corresponding to the evaluation limit value BWGW.

The method according to the invention is performed as follows:

The electronic control unit issues an energization begin BB and an energization end BE for the fuel injector. This period corresponds to the energization duration BD. From the pressure curve pE(i) of the individual storage chamber, the actual injection end can be recognized. For example, at the point E, there is the pressure value pE(SE) and the respective time value tE (dashed line). From this injection end, by a mathematical function, the respective virtual injection begin can be calculated which, in this case, is the point D with the time value tD. Such a calculation method is known from the German patent application DE 103 44 181.6. The disclosure content of this application is included herein by reference. Of course, the injection begin can also be determined indirectly from the measuring values of the individual storage chamber pressure patterns without changing the character of the invention. From the first actual injection pattern, a time tSE (IST) from the energization end BE to the measured injection end, here the time point tE, is calculated. For the injection begin, a time TSB(IST) from the energization begin BB to the virtual injection begin, time tD, is calculated. Then an injection end deviation dtSE is calculated from the desired injection pattern and the first actual injection pattern. This deviation corresponds in FIG. 3 to the distance between the points E and B. For the injection begin also an injection begin deviation dtSB is calculated. This corresponds to the difference between the two points D and A.

As next step, the injection end tolerance band TBSE is selected depending on the operating parameters of the internal combustion engine. The operating parameters of the internal combustion engine are considered to be the rail pressure, the speed of the internal combustion engine, the fuel temperature and the energization duration BD. After the selection of the tolerance band, it is examined whether the injection end deviation dtSE is within the two limit values GW1 and GW2 of the injection end tolerance band TBSE. In FIG. 3, this is the case with respect to the first actual injection pattern. Subsequently, the injection begin tolerance bond TBSB is selected and it is examined whether the injection begin deviation dtSB is disposed within the tolerance band with the limit values GW3 and GW4. In FIG. 3, the injection begin deviation dtSB (points A, D) is also within the respective tolerance band. Since the injection end deviation dtSE and also the injection begin deviation are both disposed within the respective tolerance band, the injector is considered to be fault-free.

In the second actual injection curve (dash-dotted Line) both, the injection end (point H, time tH) and the injection start (point G) are disposed outside the respective tolerance band. Next, it is examined whether the injection end value is greater than an evaluation limit value BWGW. In FIG. 3, the point H is disposed within the evaluation limit value BWGW. As a result of this examination, a diagnosis input is established which provides that, with the next servicing appointment, the injector should be replaced. Then the control parameters of the injector are adapted, particularly the energization start and the energization duration.

Figure 4A:
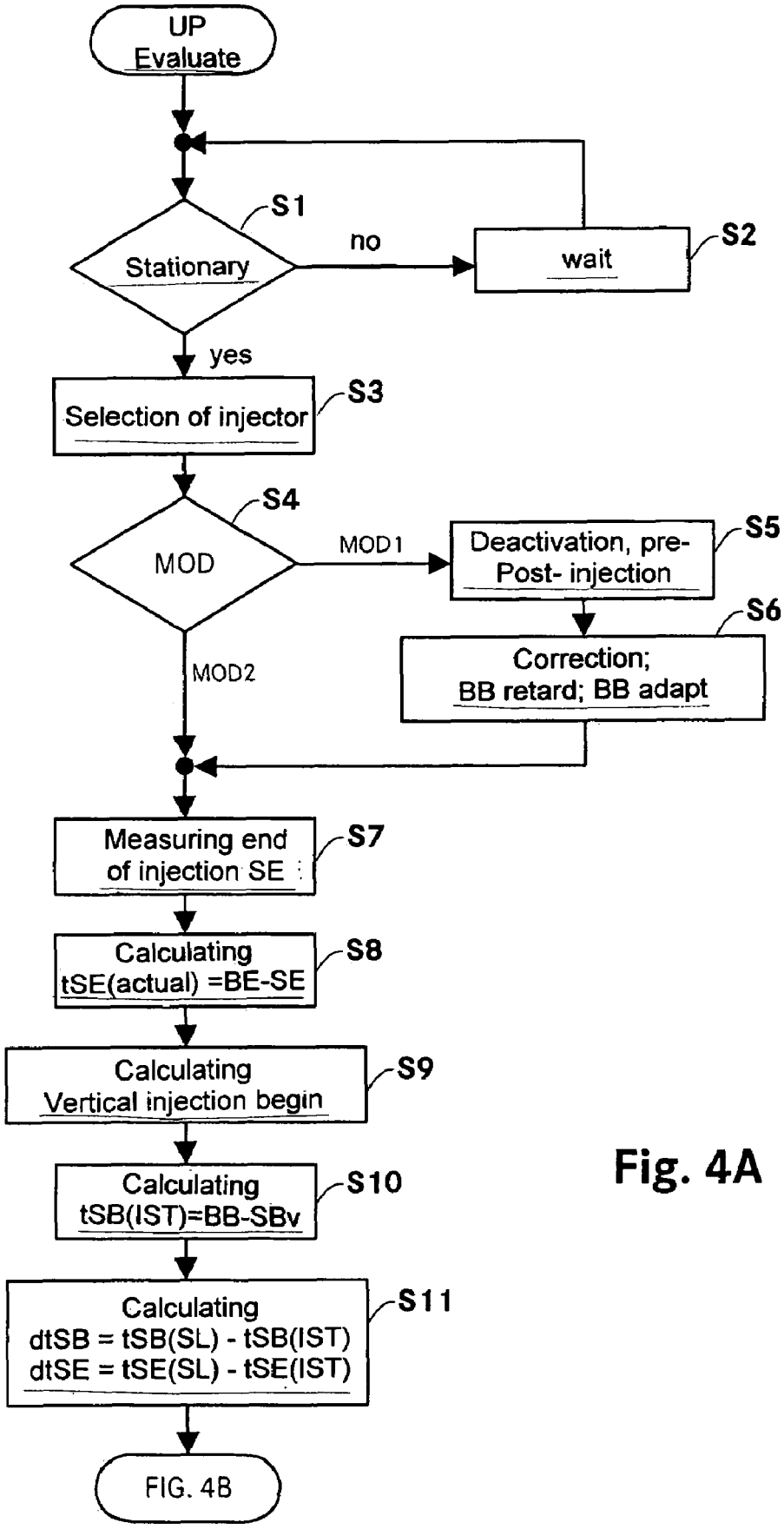
FIG. 4*a* and FIG. 4*b* show a block diagram for performing the method according to the invention.
Figure 4B:
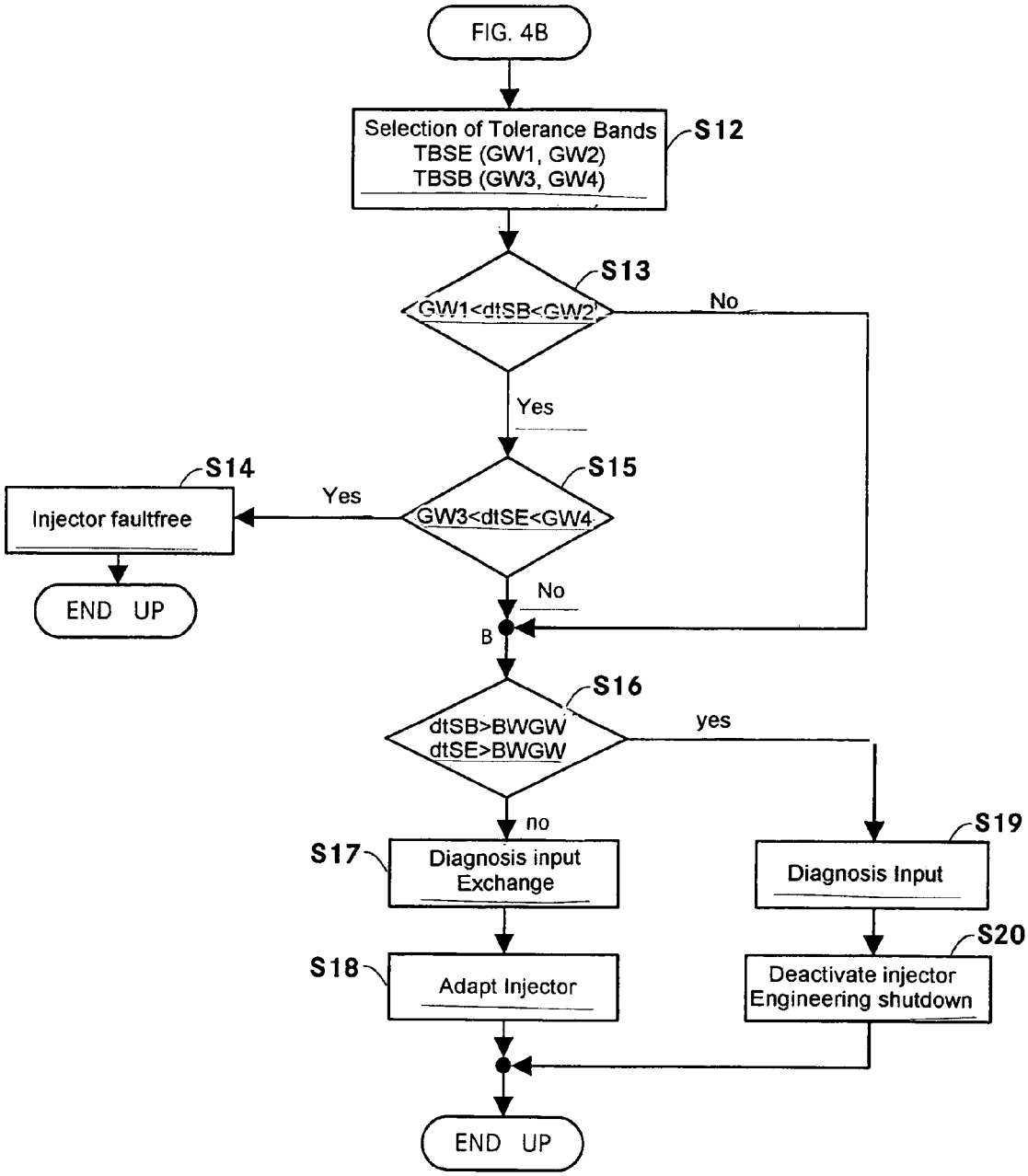

FIGS. 4A and 4B show a program for performing the method. The subprogram may be time-controlled or event-controlled if for example an excessively high exhaust gas temperature variation is present. In S1, it is examined whether the engine operating state is stationary. A stationary operating state is, for example, present when the engine speed is constant. If it is determined at S1 that the operating state is not stationary, with S2 a corresponding waiting loop is included. If, in S1, the result is positive, that is the engine operating state is found to be stationary, in S3, an injector to be evaluated is selected. In S4, an operating mode is selected. The operating mode is predetermined by the operator. In an operating mode MOD1 for the evaluation of the injector, the pre- and post injection is deactivated, step S5. Then, in S6, the energization begin BB is moved to late in the sense of smaller crankshaft angles before top dead center. In addition, the energization duration is adapted. At an operating mode MOD2, the injector including pre-. main- and post injection are evaluated. At S7, the injection end SE is detected. From the injection end SE, and the energization end BE, a time tSE (actual) is calculated. At S9, a virtual injection begin SBv is determined from the injection end SE. Subsequently, at S10, a time tSB (actual) is determined from the energization begin BB and the virtual injection begin SBV. At S11 from the respective desired/actual value comparison, an injection begin deviation dtSB is determined and an injection end deviation dtSE is calculated.

Depending on the operating parameters of the internal combustion engine, at S12, the injection end tolerance band TBSE and the injection begin tolerance band TBSB are calculated. At S13, it is examined whether the injection begin deviation dtSB is within the tolerance band. If this is not the case, the program is continued at point B. If the examination finds at S13, that the injection begin deviation dtSB is within the injection begin tolerance band TBSB with the limit values GW1 and GW2, it is examined at S15 whether the injection end deviation dtSE is within the injection end tolerance band TBSE with the limit values GW3 and GW4. If the injection begin deviation as well as the injection end deviation are within the respective tolerance bands, the injector is evaluated fault-free at S14 and the subprogram is terminated.

If the examination at S15 finds that the injection end deviation is outside the tolerance band, it is examined at S16 whether the injection begin deviation dtSB or the injection end deviation is greater than the evaluation limit value BWGW. If this is the case, at S19, a diagnosis input is initiated and at S20, the respective injector is deactivated. Alternatively, it can be provided that, instead of the deactivation of the injector, the internal combustion engine is shut down. Then the program execution is terminated for that case. If the examination at S16 finds that the injection end deviation and the injection begin deviation are smaller than the evaluation limit value BWGW, at S17 a diagnosis entry is initiated. The diagnosis entry recommends to the service technician to exchange the respective injector during the following service appointment. Then, at S18, the control parameters of the injector are adapted and the program execution is terminated.

What is claimed is:

1. A method of controlling an internal combustion engine (1) having a common rail fuel injection system including for each cylinder an individual fuel storage chamber (8) wherein the fuel pressure is sensed and from the pressure pattern (pE(i), I=1, 2 . . . n) of the individual fuel storage chambers (8) an actual injection end (SE(IST)) is determined, said method comprising the steps of: calculating a fuel injection end deviation (dtSE) from a desired injection end (SE(SL)) and the actual injection end (SE(IST)), calculating an injection begin deviation (dtSB) from a desired injection begin (SB(SL)) and the virtual actual injection begin (SBv(IST)), evaluating an injector (7) on the basis of the injection end deviation (dtSE) and the injection begin deviation (dtSB) and basing the further control of the internal combustion engine (1) on the injector evaluation.

2. A method according to claim 1, wherein an injection end tolerance band (TBSE) is selected and it is examined whether the injection end deviation (dtSE) is within the injection end tolerance band (TBSE).

3. A method according to claim 1, wherein an injection begin tolerance band (TBSB) is selected and it is examined whether the injection begin deviation (dtSB) is within the injection begin tolerance band (TBSB).

4. A method according to claim 1, wherein an injection end tolerance band (TBSE) is selected and it is examined whether the injection end deviation (dtSE) is within the injection end tolerance band (TBSE) and an injection begin tolerance band (TBSB) is selected and it is examined whether the injection begin deviation (dtSB) is within the injection begin tolerance band (TBSB) and the injector (7) is evaluated as being fault free when the injection end deviation (dtSE) and the injection begin deviation (dtSB) are within the respective tolerance bands (TBSE, TBSB).

5. A method according to claim 4, wherein the injector (7) is evaluated as being faulty if one of the injection end deviation (dtSE) and the injection begin deviation (dtSB) is outside the injection end tolerance band (TBSE) or, respectively, the injection begin tolerance band (TBSB).

6. A method according to claim 5, wherein, upon an evaluation of an injector (7) as being faulty, it is examined whether the injection end deviation (dtSE) or the injection begin deviation (dtSB) are greater than a limit value (BWGW) and, depending on the comparison, either the control parameters of the injector (7) are adapted (dtSE<BWGW; dtSB<BWGW) or the injector (7) is deactivated (dtSE>BWGW; dtSB>BWGW) or the internal combustion engine is shut down.

7. A method according to claim 6, wherein the control parameters of the injector (7) for each pre- main- and post injection and for multiple injections are adapted.

8. A method according to claim 6, wherein a diagnosis entry is made.

9. A method according to claim 1, wherein the evaluation of the injector (7) is performed at a stationary operating state of the internal combustion engine (1).

10. A method according to claim 9, wherein, during the evaluation of the injector (7), pre-injection and post-injections are deactivated.

11. A method according to claim 10, wherein, upon deactivation, control parameters of the injector (7) including the energization begin and the energization duration are adapted.

* * * * *